US011098270B2

(12) United States Patent
O'Neil et al.

(10) Patent No.: US 11,098,270 B2
(45) Date of Patent: Aug. 24, 2021

(54) FABRIC TREATMENT COMPOSITIONS AND METHODS FOR PROVIDING A BENEFIT

(71) Applicant: The Procter & Gamble Company, Cincinnati, OH (US)

(72) Inventors: Julie Ann O'Neil, Dillsboro, IN (US); Renae Dianna Fossum, Middletown, OH (US); Gledison Fonseca, Mannheim (DE); Aaron Flores-Figueroa, Mannheim (DE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 16/405,409

(22) Filed: May 7, 2019

(65) Prior Publication Data

US 2019/0264142 A1 Aug. 29, 2019

Related U.S. Application Data

(63) Continuation of application No. PCT/US2017/061493, filed on Nov. 14, 2017.

(60) Provisional application No. 62/424,171, filed on Nov. 18, 2016.

(51) Int. Cl.

| | |
|---|---|
| ***C11D 3/50*** | (2006.01) |
| ***C11D 1/66*** | (2006.01) |
| ***C11D 1/835*** | (2006.01) |
| ***C11D 3/22*** | (2006.01) |
| ***C11D 3/37*** | (2006.01) |
| *C11D 1/62* | (2006.01) |
| *C11D 3/00* | (2006.01) |
| *C11D 11/00* | (2006.01) |

(52) U.S. Cl.

CPC ..... *C11D 3/50* (2013.01); *C11D 1/662* (2013.01); *C11D 1/835* (2013.01); *C11D 3/222* (2013.01); *C11D 3/3769* (2013.01); *C11D 1/62* (2013.01); *C11D 3/001* (2013.01); *C11D 11/0017* (2013.01)

(58) Field of Classification Search

CPC . A61Q 5/02; A61Q 19/10; A61Q 5/12; A61Q 19/00; C11D 17/0013; C11D 3/50; C11D 3/3769; C11D 3/37; C11D 3/3723; C11D 1/662

See application file for complete search history.

(56) References Cited

U.S. PATENT DOCUMENTS

| | | | |
|---|---|---|---|
| 5,114,600 | A | 5/1992 | Biggin |
| 5,811,087 | A | 9/1998 | Moehring |
| 6,251,849 | B1 | 6/2001 | Jeschke |
| 6,642,200 | B1 | 11/2003 | Zhang |
| 6,864,223 | B2 | 3/2005 | Smith |
| 7,304,026 | B2 | 12/2007 | Heibel |
| 7,452,854 | B2 | 11/2008 | Green |
| 7,659,238 | B2 | 2/2010 | Martin |
| 8,183,199 | B2 | 5/2012 | Fossum |
| 8,546,314 | B2 | 10/2013 | Randall |
| 9,080,130 | B2 | 7/2015 | Sivik |
| 9,404,068 | B2 | 8/2016 | Sakurai |
| 9,534,191 | B2 * | 1/2017 | Fernandez-Prieto ..... C12N 9/2422 |
| 9,809,782 | B2 | 11/2017 | Panandiker |
| 2001/0034315 | A1 | 10/2001 | Grainger |
| 2002/0132749 | A1 | 9/2002 | Smith et al. |
| 2004/0023836 | A1 | 2/2004 | Moorfield |
| 2004/0116321 | A1 | 6/2004 | Salesses et al. |
| 2005/0256027 | A1 | 11/2005 | Heibel et al. |
| 2006/0094639 | A1 | 5/2006 | Martin |
| 2006/0252669 | A1 | 11/2006 | Heibel et al. |
| 2007/0099817 | A1 | 5/2007 | Smith et al. |
| 2007/0202069 | A1 | 8/2007 | Tamareselvy |
| 2008/0167453 | A1 | 7/2008 | Goettel et al. |
| 2010/0050346 | A1 | 3/2010 | Corona, III |
| 2010/0056419 | A1 | 3/2010 | Corona, III |
| 2010/0325812 | A1 | 12/2010 | Panandiker |
| 2011/0184040 | A1 | 7/2011 | Taranta |
| 2011/0269663 | A1 | 11/2011 | Clowes et al. |
| 2011/0281782 | A1 | 11/2011 | Panandiker |
| 2012/0004156 | A1 | 1/2012 | Panandiker |
| 2012/0027824 | A1 | 2/2012 | Ernenwein |
| 2012/0031421 | A1 | 2/2012 | Washington |
| 2012/0071383 | A1 * | 3/2012 | Perez-Prat Vinuesa ..... C11D 3/382 510/236 |
| 2012/0077725 | A1 | 3/2012 | Wang |
| 2012/0137448 | A1 | 6/2012 | Panandiker |
| 2012/0142578 | A1 | 6/2012 | Panandiker |
| 2013/0108571 | A1 | 5/2013 | Adamy |
| 2013/0121944 | A1 | 5/2013 | Leyrer et al. |
| 2013/0310301 | A1 | 11/2013 | Sivik |
| 2015/0017214 | A1 | 1/2015 | Warr |
| 2015/0159119 | A1 | 6/2015 | Fernandez-Prieto et al. |
| 2015/0197708 | A1 | 7/2015 | Jin |
| 2015/0329799 | A1 | 11/2015 | Schramm, Jr. |
| 2016/0024427 | A1 | 1/2016 | Sivik et al. |
| 2016/0032220 | A1 | 2/2016 | Sivik |

(Continued)

FOREIGN PATENT DOCUMENTS

| | | | |
|---|---|---|---|
| CA | 2482306 | A1 | 3/2003 |
| DE | 10200474 | A1 | 7/2003 |
| EP | 1375633 | A1 | 1/2004 |
| JP | 20100529269 | A | 8/2010 |
| JP | 2010285737 | A | 12/2010 |
| WO | WO9420597 | A1 | 9/1994 |

(Continued)

OTHER PUBLICATIONS

International Search Report; International Application No. PCT/US2017/061493; dated Jan. 23, 2018; 13 pages.

(Continued)

*Primary Examiner* — John R Hardee

(74) *Attorney, Agent, or Firm* — Gregory S. Darley-Emerson

(57) ABSTRACT

A fabric treatment composition having from about 2.5% to about 20% of a cationic polymer, from about 0.1% to about 20% of a perfume, and a surfactant system, the surfactant system having alkyl polyglucoside, and the composition having less than 5% by weight of an anionic surfactant.

19 Claims, No Drawings

(56) References Cited

U.S. PATENT DOCUMENTS

| | | | |
|---|---|---|---|
| 2016/0060574 | A1 | 3/2016 | Panandiker |
| 2016/0237381 | A1 | 8/2016 | Chen |
| 2016/0296656 | A1 | 10/2016 | Scavone |
| 2017/0298294 | A1 | 10/2017 | KÖhle |
| 2018/0142187 | A1 | 5/2018 | Fossum |
| 2018/0142188 | A1 | 5/2018 | Fossum |

FOREIGN PATENT DOCUMENTS

| | | | |
|---|---|---|---|
| WO | WO02057400 | A2 | 7/2002 |
| WO | WO03102043 | A1 | 12/2003 |
| WO | WO2004050812 | A1 | 6/2004 |
| WO | WO2005087907 | A1 | 9/2005 |
| WO | WO2008005693 | A2 | 1/2008 |
| WO | WO2015143997 | A1 | 10/2015 |
| WO | WO2016014744 | A1 | 1/2016 |

OTHER PUBLICATIONS

International Search Report; International Application No. PCT/US2017/061494; dated Jan. 30, 2018; 14 pages.
International Search Report; International Application No. PCT/US2017/062243; dated Feb. 27, 2018; 13 pages.
Luviquat® Polymer Grades; Quaternized copolymers for hair and skin care; Technical Information; Nov. 2005; Supersedes issue dated Oct. 2005; downloaded Aug. 11, 2020; http://www.rumapel.com.ar/cosmetica_agentes/ficha_tecnica/Luviquat%20Polymer%20Grades.pdf; 32 pages; BASF Aktiengesellschaft.
All Office Actions, U.S. Appl. No. 15/356,101.
All Office Actions, U.S. Appl. No. 15/356,125.

* cited by examiner

FABRIC TREATMENT COMPOSITIONS AND METHODS FOR PROVIDING A BENEFIT

FIELD OF THE INVENTION

The present disclosure is directed to fabric treatment compositions, and methods of using the same.

BACKGROUND OF THE INVENTION

When consumers wash their clothes, they not only want their clothes to be clean, but they often want their fabrics to feel soft, smell fresh, and maintain the same initial appearance so they are like when new. Conventional detergents often provide desirable cleaning and stain removal benefits, but washed fabrics typically lack the "soft feel" benefits that consumers enjoy. Washed fabrics may lose some of the initial appearance from purchase because the color has faded or lost some of its original intensity after washing. To provide the soft feel and freshness benefits, consumers typically will add fabric softeners to their laundry regimen. Fabric softeners are known to deliver soft feel through the rinse cycle. However, fabric softener actives can build up on fabrics over time. This build up can lead to an undesirable, heavy feel on fabrics, or lead to a decrease in whiteness.

The color of new fabrics can appear faded or dull after laundering due to fabric abrasion that occurs during the wash process. This abrasive damage leads to fibers loosening, and fibrils or fuzz being formed. Protruding fibers or fibrils may scatter light, and produce an optical effect of diminished color intensity. One way to maintain, or improve, the color on damaged fabrics is via water insoluble, hydrophobic particles formed from cationic polymer and anionic surfactant via a coacervate. These hydrophobic particles deposit on the fabric surface to prevent abrasion, and they can re-set fibers or fibrils on damaged fabrics. Resetting the fibers or fibrils is believed to result in smoother yarns, thereby reducing the number of fibers or fibrils protruding from the fabric surface. As a result, there is less light scattering from the fabric and a more intense color is perceived by the consumer.

Wash-added compositions have been described that combine cationic polymer and anionic surfactant in a wash-added composition. However, the problem with these wash-added compositions is that the cationic polymer can interfere with cleaning since the anionic surfactant needed for cleaning forms a coacervate with the cationic polymer, and the coacervate formed during the wash process can re-deposit the dirt that is removed from the clothes. A solution to these aforementioned problems is to add the cationic polymer during the rinse cycle of the wash process and rely on the anionic surfactant carry-over in the rinse water, however anionic surfactant carry-over levels are low. It has been surprisingly found that high levels of cationic polymer that are in excess of the anionic carry-over in the rinse liquor may deliver the desired appearance benefit on fabrics. Without wishing to be bound by theory, the excess cationic polymers are able to reset fibers or fibrils when they go through a tacky phase upon drying.

Formulating compositions that deliver appearance, softness, and freshness benefits is a challenge to manufacturers. Simply emulsifying an appearance benefit agent, such as a high-level of cationic polymer, with a freshness agent, such as perfume, may cause phase separation or stability problems. To stabilize the emulsion, manufacturers may add an anionic surfactant to the composition. However, it has been found that anionic surfactants and cationic polymers may readily form a complex or precipitate in the bottle. This complex or precipitate is undesirable since it may increase the rheology of the composition making it difficult to pour, or phase-separate making uniform dispensing difficult for the consumer. Furthermore, the complex or precipitate formed in the bottle may be rinsed away rather than depositing on garments. Losing the benefit agent with the rinse is an inefficient use of the benefit agent. Rather than use an anionic surfactant to stabilize the emulsion, manufacturers may use a nonionic surfactant. However, many nonionic surfactants may not enable phase stability of the composition across a wide range of temperatures relevant to the supply and distribution chains.

Therefore, there is a need to provide a single rinse-added product that provides softness and freshness benefits that also maintains, or even improves, the appearance of clothes.

SUMMARY OF THE INVENTION

A fabric treatment composition comprising from about 2.5% to about 20% by weight of the composition of a cationic polymer; from about 0.1% to about 20% by weight of the composition of a perfume; and a surfactant system, wherein said surfactant system comprises alkyl polyglucoside; and wherein the composition comprises less than 5% by weight of the composition of an anionic surfactant.

DETAILED DESCRIPTION OF THE INVENTION

The present disclosure relates to fabric treatment compositions comprising from about 2.5% to about 20% by weight of the composition of a cationic polymer; from about 0.1% to about 20% by weight of the composition of a perfume; and a surfactant system, wherein said surfactant system comprises alkyl polyglucoside; and wherein said composition comprises less than 5% by weight of the composition of an anionic surfactant. The fabric treatment compositions of the present disclosure can be used during the rinse cycle to deliver softness, and freshness benefits and can also maintain, or even improve, the appearance of clothes. These benefits can be provided by selecting particular cationic deposition polymers, particular perfume systems, and particular surfactant systems. Each of these elements is detailed herein. The balance of the composition by weight may be of water.

CATIONIC POLYMER

The fabric treatment composition may comprise from about 2.5% to about 20% by weight of the composition of a cationic polymer. The fabric treatment composition may comprise from about 5% to about 15% by weight of the composition of a cationic polymer. The fabric treatment composition may comprise from about 7% to about 10% by weight of the composition of a cationic polymer. "Cationic polymer" may mean a polymer having a net cationic charge at a pH of from about 2 to about 7.

The cationic polymer may comprise a polymer selected from the group consisting of cationic celluloses, cationic guars, poly(acrylamide-co-diallyldimethylammonium chloride), poly(acrylamide-co-diallyldimethylammonium chloride-co-acrylic acid), poly(acrylamide-co-methacryloamidopropyl-pentamethyl-1,3-propylene-2-ol-ammonium dichloride), poly(acrylamide-co-N,N-dimethylaminoethyl acrylate) and its quaternized derivatives, poly(acrylamide-co-N,N-dimethylaminoethyl methacrylate) and its quaternized derivatives, poly(acrylamide-co-methacrylamidopropyltrimethyl ammonium chloride), poly(acrylamide-co-methacrylamidopropyltrimethyl ammonium chloride-co-acrylic acid), poly(diallyldimethyl ammonium chloride), poly(diallyldimethylammonium chloride-co-acrylic acid), poly(ethyl methacrylate-co-oleyl methacrylate-co-diethylaminoethyl methacrylate) and its quaternized derivatives, poly(ethyl methacrylate-co-dimethylaminoethyl methacrylate) and its quaternized derivatives, poly(hydroxpropylacrylate-co-methacrylamidopropyltrimethylammonium chloride), poly(hydroxyethylacrylate-co-dimethyl aminoethyl methacrylate) and its quaternized derivatives, poly (methylacrylamide-co-dimethylaminoethyl acrylate) and its quaternized derivatives, poly(methacrylate-co-methacrylamidopropyltrimethyl ammonium chloride), poly(vinylformamide-co-diallyldimethylammonium chloride-co-acrylic acid), poly(vinylformamide-co-diallyldimethylammonium chloride), poly(vinylpyrrolidone-co-acrylamide-co-vinyl imidazole) and its quaternized derivatives, poly(vinylpyrrolidone-co-dimethylaminoethyl methacrylate) and its quaternized derivatives, poly(vinylpyrrolidone-co-methacrylamide-co-vinyl imidazole) and its quaternized derivatives, poly (vinylpyrrolidone-co-vinyl imidazole) and its quaternized derivatives, polyethyleneimine and including its quaternized derivatives, and mixtures thereof.

The cationic polymer may comprise a polymer selected from the group consisting of poly(acrylamide-co-diallyldimethylammonium chloride), poly(diallyldimethylammonium chloride-co-acrylic acid), poly(methylacrylamide-co-dimethylaminoethyl acrylate) and its quaternized derivatives, poly(vinylformamide-co-diallyldimethylammonium chloride-co-acrylic acid), poly(vinylformamide-co-diallyldimethylammonium chloride), poly(vinylpyrrolidone-co-acrylamide-co-vinyl imidazole) and its quaternized derivatives, poly(vinylpyrrolidone-co-methacrylamide-co-vinyl imidazole) and its quaternized derivatives, and mixtures thereof.

Without wishing to be bound by theory, a polymer selected from the immediately preceding group may provide the benefit of providing color rejuvenation and maintenance benefits without causing negative tactile effects to the wet or dry feel of the fabric, such as, for example, a wet and/or sticky feel on the fabric. Cationic polymers selected from the group consisting of the immediately preceding list generally have a weight-average molecular weight of from about 15,000 to about 600,000 Daltons.

The cationic polymer may comprise poly(diallyldimethylammonium chloride-co-acrylic acid). The use of poly (diallyldimethylammonium chloride-co-acrylic acid) may provide exceptional color rejuvenating and maintenance benefits. Poly(diallyldimethylammonium chloride-co-acrylic acid) has a weight-average molecular weight of about 450,000 Daltons. Without wishing to be bound by theory, it is believed that when placed into contact with an external source of anionic surfactant and/or cationic surfactant, poly(diallyldimethylammonium chloride-co-acrylic acid) may form a separated phase where the separated phase formed may have a desirable rheology, particle size, and thermal properties that may provide color rejuvenation and maintenance benefits to the fabric without causing negative tactile effects to the wet or dry feel of the fabric, such as, for example, a wet and/or sticky feel on the fabric.

The cationic polymers of the present disclosure may be characterized by a calculated cationic density. The cationic polymer may have a cationic charge density of from greater than 0 to about 6 meq/g when calculated at a pH of from about 2 to about 8. Without wishing to be bound by theory, it is believed that cationic polymers of the present disclosure having a cationic charge density of from greater than 0 to about 6 meq/g when calculated at a pH of from about 2 to about 8 may maintain the polymer's stability when added to a composition with other components such as a perfume to create an emulsion. Without wishing to be bound by theory, an upper limit on the cationic charge density of about 6 meq/g at a pH of from about 2 to about 8 may be desired, since the viscosity of cationic polymers having cationic charge densities that are too high may lead to formulation challenges.

As used herein, the term "cationic charge density" (CCD) means the amount of net positive charge present per gram of the polymer. CCD (in units of equivalents of charge per gram of polymer) may be calculated according to the following equation:

$$CCD = \frac{(Qc \times \text{mol } \%\ c) - (Qa \times \text{mol } \%\ a)}{(\text{mol } \%\ c \times MWc) + (\text{mol } \%\ n \times Mwn) + (\text{mol } \%\ a \times MWa)}$$

where: Qc and Qa are the molar equivalents of charge of the cationic, nonionic, and anionic repeat units (if any), respectively; mol % c, mol % n, and mol % a are the molar ratios of the cationic, nonionic, and anionic repeat units (if any), respectively; and MWc, MWn, and MWa are the molecular weights of the cationic, nonionic, and anionic repeat units (if any), respectively. To convert equivalents of charge per gram to milliequivalents of charge per gram (meq/g), multiply equivalents by 1000. If a polymer comprises multiple types of cationic repeat units, multiple types of nonionic repeat units, and/or multiple types of anionic repeat units, the equation can be adjusted accordingly. As used herein "mol %" refers to the relative molar percentage of a particular monomeric structural unit in a polymer. It is understood that within the meaning of the present disclosure, the relative molar percentages of all monomeric structural units that are present in the cationic polymer add up to 100 mol %.

By way of example, a cationic homopolymer (molar ratio=100% or 1.00) having a monomer molecular weight of 161.67 g/mol, the CCD is calculated as follows: polymer charge density is (1)×(1.00)/(161.67)×1000=6.19 meq/g. A copolymer having a cationic monomer with a molecular weight of 161.67 and a neutral co-monomer having a molecular weight of 71.079 in a mol ratio of 1:1 is calculated as (1×0.50)/[(0.50×161.67)+(0.50×71.079)]×1000=4.3 meq/g. A terpolymer having a cationic monomer having a molecular weight of 161.67, a neutral co-monomer having a molecular weight of 71.079, and an anionic co-monomer having a neutralized molecular weight of 94.04 g/mol in a mol ratio of 80.8:15.4:3.8 has a CCD of 5.3 meq/g.

The cationic polymer may have a weight-average molecular weight from about 15,000 to about 600,000 Daltons. The cationic polymer may have a weight-average molecular weight from about 20,000 to about 550,000 Daltons. The cationic polymer may have a weight-average molecular weight from about 50,000 to about 500,000 Daltons. The cationic polymer may have a weight-average molecular weight from about 100,000 to about 500,000 Daltons. Weight-average molecular weight may be determined by size exclusion chromatography relative to polyethyleneoxide standards with RI detection. As used herein, the term "molecular weight" refers to the weight-average molecular weight of the polymer chains in a polymer composition.

Further, as used herein, the "weight-average molecular weight" ("Mw") is calculated using the equation:

$$Mw = \frac{(\Sigma i\, Ni\, Mi^2)}{(\Sigma i\, Ni\, Mi)}$$

where Ni is the number of molecules having a molecular weight Mi.

Without wishing to be bound by theory, it is believed that cationic polymers having a weight-average molecular weight of from about 15,000 to about 600,000 Daltons may provide a color rejuvenation benefit to fabric. Without wishing to be bound by theory, it is believed that water soluble cationic polymers having a weight-average molecular weight of less than 15,000 Daltons may not deposit as readily onto fabric when compared to water soluble cationic polymers of the present disclosure having a weight-average molecular weight of about 15,000 Daltons or greater. Without wishing to be bound by theory, water soluble cationic polymers of the present disclosure having a weight-average molecular weight of greater than 600,000 Daltons may result in undesirable build-up, which may cause, for example, a wet and/or sticky feel, on fabric due to the higher rheology of the high molecular weight polymer.

In one aspect, the cationic polymer may be poly(diallyldimethylammonium chloride-co-acrylic acid) and may have a weight-average molecular weight of about 450,000 Daltons.

The cationic polymer may comprise charge neutralizing anions such that the overall polymer is neutral under ambient conditions. Suitable counter ions include (in addition to anionic species generated during use) chloride, bromide, sulfate, methylsulfate, sulfonate, methylsulfonate, carbonate, bicarbonate, formate, acetate, citrate, nitrate, and mixtures thereof.

In one aspect, the cationic polymer may comprise less than 0.01% by mole of a cross-linking agent.

PERFUME AND PERFUME DELIVERY TECHNOLOGY

The fabric treatment composition may comprise from about 0.1% to about 20% by weight of the composition of a perfume. Without wishing to be bound by theory, encapsulated perfumes can enhance the fabric treatment experience by improving perfume release by depositing onto fabrics and later rupturing, resulting in greater scent intensity and noticeability. Perfume ingredients useful in the present compositions and processes comprise a wide variety of natural and synthetic chemical ingredients, including, but not limited to, aldehydes, ketones, esters, and the like. Also included are various natural extracts and essences which can comprise complex mixtures of ingredients, such as orange oil, lemon oil, rose extract, lavender, musk, patchouli, balsamic essence, sandalwood oil, pine oil, cedar, and the like. Finished perfumes can comprise complex mixtures of such ingredients. The fabric treatment composition may comprise a perfume raw material having a ClogP of less than or equal to about 3.

The fabric treatment composition may comprise raw materials selected from the group consisting of melonal, dihydro myrcenol, freskomenthe, tetra hydro linalool, linalool, anisic aldehyde, citronellol, ionone beta, ionone alpha, geraniol, delta damascone, thio-damascone, bourgeonal, cymal, alpha damascone, ethyl linalool, lilial, ionone gamma methyl, helional, cashmeran, vanillin, amyl salicylate, ethyl vanillin, calone, iso e super, hexyl salicylate, galaxolide, nectaryl, benzyl salicylate, trichloromethyl phenyl carbinyl acetate, β-Damascenone, dihydro beta ionone, ligustral, triplal, beta naphthol methyl ether, and mixtures thereof.

In one aspect, the fabric treatment composition may comprise a perfume comprising thio-damascone, such as, for example, HALOSCENT® D made available by Firmenich, Geneva, Switzerland. Perfumes comprising thio-damascone may deliver provide prolonged perfume release by delivery of a high impact accord (HIA) perfume ingredient that may deposit readily onto fabrics.

The fabric treatment compositions disclosed herein may comprise a perfume selected from the group consisting of an encapsulated perfume, an unencapsulated perfume, and mixtures thereof.

The term "unencapsulated perfume" is used herein in the broadest sense and may mean a composition comprising free perfume ingredients wherein the free perfume ingredients are neither absorbed onto or into a perfume carrier (e.g., absorbed on to zeolites or clays or cyclodextrin) nor encapsulated (e.g., in a perfume encapsulate). An unencapsulated perfume ingredient may also comprise a pro-perfume, provided that the pro-perfume is neither absorbed nor encapsulated. Non-limiting examples of suitable perfume ingredients include blooming perfumes, perfume oils, and perfume raw materials comprising alcohols, ketones, aldehydes, esters, ethers, nitriles alkenes, and mixtures thereof. Non-limiting examples of blooming perfume ingredients that may be useful in the products of the present disclosure are given in U.S. Patent Publication 2005/0192207 A1.

The term "encapsulated perfume" is used herein in the broadest sense and may include the encapsulation of perfume or other materials or actives in small capsules (i.e., encapsulates), typically having a diameter less than about 100 microns. These encapsulates may comprise a spherical outer shell containing water insoluble or at least partially water insoluble material, typically polymer material, within which the active material, such as perfume, is contained.

The encapsulated perfume may have a shell, which may at least partially surround the core. The shell may include a shell material selected from the group consisting of polyethylenes; polyamides; polystyrenes; polyisoprenes; polycarbonates; polyesters; polyacrylates; acrylics; aminoplasts; polyolefins; polysaccharides, such as alginate and/or chitosan; gelatin; shellac; epoxy resins; vinyl polymers; water insoluble inorganics; silicone; and mixtures thereof. The shell material may be selected from the group consisting of an aminoplast, an acrylic, an acrylate, and mixtures thereof.

The shell material may include an aminoplast. The aminoplast may include a polyurea, polyurethane, and/or polyurea/urethane. The aminoplast may include an aminoplast copolymer, such as melamine-formaldehyde, urea-formaldehyde, cross-linked melamine formaldehyde, and mixtures thereof. The shell material may include melamine formaldehyde, and the shell may further include a coating as described below. The encapsulated perfume may include a core that comprises perfume, and a shell that includes melamine formaldehyde and/or cross linked melamine formaldehyde. The encapsulated perfume may include a core that comprises perfume, and a shell that comprises melamine formaldehyde and/or cross linked melamine formaldehyde, poly(acrylic acid) and poly(acrylic acid-co-butyl acrylate).

The outer wall of the encapsulated perfume may include a coating. Certain coatings may improve deposition of the encapsulated perfume onto a target surface, such as a fabric.

The encapsulated perfume may have a coating-to-wall weight ratio of from about 1:200 to about 1:2, or from about 1:100 to about 1:4, or even from about 1:80 to about 1:10.

The coating may comprise an efficiency polymer. The coating may comprise a cationic efficiency polymer. The cationic polymer may be selected from the group consisting of polysaccharides, cationically modified starch, cationically modified guar, polysiloxanes, poly diallyl dimethyl ammonium halides, copolymers of poly diallyl dimethyl ammonium chloride and vinyl pyrrolidone, acrylamides, imidazoles, imidazolinium halides, imidazolium halides, polyvinyl amines, polyvinyl formamides, polyallyl amines, copolymers thereof, and mixtures thereof. The coating may comprise a polymer selected from the group consisting of polyvinyl amines, polyvinyl formamides, polyallyl amines, copolymers thereof, and mixtures thereof.

The coating may comprise polyvinyl formamide. The polyvinyl formamide may have a hydrolysis degree of from about 5% to about 95%, from about 7% to about 60%, or even from about 10% to about 40%.

In one aspect, the perfume may be an encapsulated perfume having a shell, wherein the shell may comprise a material selected from the group consisting of aminoplast copolymer, melamine formaldehyde or urea-formaldehyde or cross-linked melamine formaldehyde, an acrylic, an acrylate and mixtures thereof. In one aspect, the perfume may be an encapsulated perfume having a shell, wherein the shell may comprise a material selected from the group consisting of melamine formaldehyde, cross-linked polyacrylate, polyurea, polyurethanes, and mixtures thereof.

The encapsulated perfume may comprise a friable perfume encapsulate. Friability refers to the propensity of the encapsulate to rupture or break open when subjected to direct external pressures or shear forces. As disclosed herein, an encapsulate is "friable" if, while attached to fabrics treated therewith, the encapsulate can be ruptured by the forces encountered when the capsule-containing fabrics are manipulated by being worn or handled (thereby releasing the contents of the capsule). Friable perfume encapsulates can be attractive for use in fabric treatment compositions because not only do the friable perfume encapsulates enable top-note scent characters to deposit easily onto fabrics during the fabric treatment process, but they also allow the consumer to experience these scent types throughout the day while wearing their article of clothing. Friable perfume encapsulates rupture and release perfume by a mechanical means (e.g., friction), not a chemical means (e.g., water hydrolysis). Minimal fracture pressure is typically needed to break the structure such as normal everyday physical movements such as taking off a jacket; pulling a shirt off; or taking off/putting on socks. Non-limiting examples of perfume encapsulates suitable as an encapsulated perfume are available in the following references: U.S. Patents and Publications U.S. Pat. Nos. 6,645,479; 6,200,949; 4,882,220; 4,917,920; 4,514,461; 4,234,627; 2003/215417 A1; 2003/216488 A1; 2003/158344 A1; 2003/165692 A1; 2004/071742 A1; 2004/071746 A1; 2004/072719 A1; 2004/072720 A1; 2003/203829 A1; 2003/195133 A1; 2004/087477 A1; 2004/0106536 A1 and EP Patent Publication 1393706 A1. The perfume encapsulate may encapsulate a blooming perfume composition, wherein the blooming perfume composition comprises blooming perfume ingredients.

The perfume may be added to the cationic polymer as an emulsion.

SURFACTANT SYSTEM

The fabric treatment composition may comprise a surfactant system. The fabric treatment composition may comprise from about 1% to about 20% by weight of the composition of a surfactant system, wherein the surfactant system is substantially free of an anionic surfactant. In one aspect, the fabric treatment composition may comprise from about 2% to about 15% by weight of the composition of a surfactant system. In one aspect, the fabric treatment composition may comprise from about 2% to about 8% by weight of the composition of a surfactant system. Without wishing to be bound by theory, when the perfume is added to the cationic polymer as an emulsion, the perfume may not be stable within the aqueous high-level cationic polymer solution. To stabilize the emulsion, a surfactant system may be added to the fabric treatment composition.

The fabric treatment composition may comprise a nonionic surfactant. The surfactant system may comprise at least 90% by weight of the surfactant system of nonionic surfactant. The surfactant system may comprise at least 80% by weight of the surfactant system of nonionic surfactant. The surfactant system may comprise at least 70% by weight of the surfactant system of nonionic surfactant. The surfactant system may comprise at least 60% by weight of the surfactant system of nonionic surfactant. The surfactant system may comprise at least 50% by weight of the surfactant system of nonionic surfactant. The surfactant system may comprise at least 40% by weight of the surfactant system of nonionic surfactant. The surfactant system may comprise from about 40% to about 100% by weight of the surfactant system of nonionic surfactant, specifically reciting all 1% increments within the specified ranges and all ranges formed therein or thereby. For the purposes of the present disclosure, nonionic surfactants may be defined as substances having molecular structures having a hydrophilic and a hydrophobic part. The hydrophobic part consists of a hydrocarbon and the hydrophilic part of a strongly polar group. The nonionic surfactants of the present disclosure may be soluble in water. Without wishing to be bound by theory, nonionic surfactants may emulsify the perfume within the high cationic polymer fabric treatment composition.

The surfactant system may comprise alkyl polyglucoside. The surfactant system may comprise by at least 90% by weight of the surfactant system of alkyl polyglucoside. The surfactant system may comprise by at least 80% by weight of the surfactant system of alkyl polyglucoside. The surfactant system may comprise by at least 70% by weight of the surfactant system of alkyl polyglucoside. The surfactant system may comprise by at least 60% by weight of the surfactant system of alkyl polyglucoside. The surfactant system may comprise by at least 50% by weight of the surfactant system of alkyl polyglucoside. The surfactant system may comprise by at least 40% by weight of the surfactant system of alkyl polyglucoside. The surfactant system may comprise from about 40% to about 90% by weight of the surfactant system of alkyl polyglucoside, specifically reciting all 1% increments within the specified ranges and all ranges formed therein or thereby. As used herein, the surfactant system may comprise alkyl polyglucosides of the general formula $R—O—(CH_2CH_2O)_n-G_x$, wherein R denotes an alkyl group having 8 to 18 carbon atoms, G is a sugar residue having 5 to 6 carbon atoms, n is a number from 0 to 10, and x is a number from 1.2 to 2.5. In one aspect, the alkyl group of the alkyl polyglucoside may contain on the average from about 8 to about 18 carbon atoms. One such alkyl polyglucoside may be commercially available under the trade name GLUCOPON® 225 DK, made available by BASF, Florham Park, N.J., United States. GLUCOPON® 225 DK is a nonionic surfactant having good wetting, dispersing, and surface tension reduction properties for increased soil removal and emulsion. Unlike other nonionics, GLUCOPON® 225 DK is highly soluble in concentrated alkaline/electrolyte solutions and can effectively act as a hydrotope for other less soluble components. A further benefit of GLUCOPON® 225 DK is that it is made from renewable raw materials including but not limited to glucose derived from corn, and fatty alcohols from coconut and palm kernel oils. GLUCOPON® 225 DK is mild, low in toxicity, and readily biodegradable.

Without wishing to be bound by theory, alkyl polyglucosides are capable of creating low interfacial tensions with n-alkane hydrocarbons wherein such interfacial tensions for these alkyl polyglucoside formulations can be largely independent of both temperature and salinity. As such, alkyl polyglucosides may emulsify the perfume within the high cationic polymer fabric treatment composition while enabling phase stability of the composition across a wide range of temperatures relevant to supply and distribution chains.

Additionally, the fabric treatment composition may optionally include further nonionic surfactants in addition to alkyl polyglucoside. Other such nonionic surfactants that may be less preferred are alkoxylated compounds, ethoxylated, compounds, and/or carbohydrate compounds. Without wishing to be bound by theory, such alkoxylated, ethoxylated, and carbohydrate compounds may emulsify the perfume within the high cationic polymer fabric treatment composition. However, such compounds do not enable phase stability of the composition across the wide range of temperatures relevant to supply and distribution chains.

The fabric treatment composition may be substantially free of cationic surfactant. As used herein, "substantially free of a component" refers to either the complete absence of a component or a minimal amount thereof merely as impurity or unintended byproduct of another component and that no amount of that component is deliberately incorporated into the composition.

The fabric treatment composition may comprise less than 5% by weight of the composition of an anionic surfactant. The fabric treatment composition may comprise less than 1.5% by weight of the composition of an anionic surfactant. The fabric treatment composition may be substantially free of anionic surfactant.

Without wishing to be bound by theory fabric color can appear faded or dull after laundering due to fabric to fabric abrasion that occurs during the wash process. This abrasive damage leads to fibers loosening, and fibrils or fuzz being formed. Protruding fibers or fibrils are able to scatter light, and produce an optical effect of diminished color intensity. One way to maintain, or improve, the color on damaged fabrics is via water insoluble, hydrophobic particles formed from cationic polymer and anionic surfactant via a coacervate. As used herein, a "coacervate" means a particle formed from the association of a cationic polymer and an anionic surfactant in an aqueous environment. These hydrophobic particles deposit on the fabric surface to prevent abrasion, and they can reset fibers or fibrils on damaged fabrics. Resetting the fibers or fibrils is believed to result in smoother yarns, thereby reducing the number of fibers or fibrils protruding from the fabric surface. As a result, there is less light scattering from the fabric and a more intense color is perceived by the consumer.

In addition to providing the color benefit via coacervate formation, high levels of cationic polymer that are in excess of the anionic carryover in the rinse liquor deliver the desired appearance benefit on fabrics by resetting fibers or fibrils when they go through a tacky phase upon drying on the fiber.

SUDS SUPPRESSOR

The fabric treatment composition may comprise from about 0.01% to about 1% by weight of the composition of a suds suppressor. In one aspect, the fabric treatment composition may comprise from about 0.05% to about 0.5% by weight of the composition of a suds suppressor. In one aspect, the fabric treatment composition may comprise from about 0.1% to about 0.5% by weight of the composition of a suds suppressor. Without wishing to be bound by theory, alkyl polyglucoside, when added to the fabric treatment composition having cationic polymer and perfume, may act to stabilize the fabric treatment composition. However, this in turn may create a stable foam or sudsing. Foam or sudsing is undesirable to consumers in a rinse additive in a washing machine as such foam or suds may not fully rinse and some foam or suds may remain on the garments. As such, the fabric treatment composition may comprise a suds suppressor. Without wishing to be bound by theory, a composition having greater than about 0.05% by weight of the composition of a suds suppressor may provide the benefit of lessening product foaming during use.

The suds suppressor may be silicone-based. In one aspect, the fabric treatment composition may comprise from about 0.01% to about 1% by weight of the composition of an organosilicone. The fabric treatment composition may comprise from about 0.05% to about 0.5% by weight of the composition of an organosilicone. The fabric treatment composition may comprise from about 0.1% to about 0.5% by weight of the composition of an organosilicone. Suitable organosilicones comprise Si—O moieties and may be selected from (a) non-functionalized siloxane polymers, (b) functionalized siloxane polymers, and combinations thereof. The molecular weight of the organosilicone is usually indicated by the reference to the viscosity of the material. In one aspect, the organosilicones may comprise a viscosity of from about 10 to about 2,000,000 centistokes at 25° C. In one aspect, suitable organosilicones may have a viscosity of from about 10 to about 800,000 centistokes at 25° C. Suitable organosilicones may be linear, branched or crosslinked. In one aspect, the organosilicones may be linear. A conventional suds suppressor system used in fabric treatment compositions may be based on polydimethylsiloxane and hydrophobized silica.

In one aspect, the organosilicone may be dimethicone (and) trimethylsiloxysilicate/dimethicone crosspolymer (and) glyceryl stearate (and) PEG-20 stearate. Examples include those available under the trade name XIAMETER® AFE-0020 Antifoam Emulsion, made available by Dow Corning Corporation, Midland, Mich., United States. XIAMETER® AFE-0020 Antifoam Emulsion is a highly efficient suds suppressor and defoamer at low concentration levels. XIAMETER® AFE-0020 Antifoam Emulsion is easily dispersed within aqueous systems such as within the fabric treatment composition of the present disclosure. XIAMETER® AFE-0020 Antifoam Emulsion is commonly used to suppress sudsing and to defoam in the applications of many liquid detergent and liquid fabric enhancer products.

STRUCTURING SYSTEM

The fabric treatment composition of the present disclosure may include an external structuring system. External structurants provide a structuring benefit independently from, or extrinsic from, any structuring effect of surfactants in the composition. Silicone, such as organosilicone when used as a suds suppressor, is not water soluble. A silicone-based suds suppressor may need to be suspended within the fabric treatment composition. As such, an external structuring system may be used to provide sufficient shear thinning viscosity to the composition in order to provide, for example, suitable pour viscosity, phase stability, and/or suspension capabilities. The external structuring system may be particularly useful for suspending the organosilicone-based suds suppressor and/or the encapsulates.

The fabric treatment composition may comprise from about 0.03% to about 1% by weight of the composition of an external structuring system. The fabric treatment composition may comprise from about 0.06% to about 1% by weight of the composition of an external structuring system.

The external structuring system may be of nonionic, anionic, or cationic nature. External structuring systems of nonionic nature may avoid undesirable interactions that external structuring systems of anionic and/or of cationic nature experience given that external structuring systems of nonionic nature show little interaction with the actives in the fabric treatment composition. Without wishing to be bound by theory, external structuring systems of anionic nature may form a precipitate or complex with the cationic polymer in the fabric treatment composition of the present disclosure which lowers the physical stability of the fabric treatment composition. For example, the external structuring system may comprise xanthan gum. However, without wishing to be bound by theory, xanthan gum may not ideal because xanthan gum is slightly anionic in nature, and xanthan gum may not be stable in the long-term over a broad temperature range because it may form a precipitate or complex that is not stable. Structurants that are highly anionic in nature such as, for example, hydrogenated castor oil in mixtures with anionic surfactants such as linear alkyl benzene sulfonate and alkyl ethoxylated sulfate, are also not ideal because they may more readily form a precipitate or complex with the cationic polymer in the fabric treatment composition of the present disclosure. External structurants of cationic nature such as, for example, cross-linked cationic polymers, are known in the art to be structurants. However, without wishing to be bound by theory, it is believed that such external structurants of cationic nature may phase separate in the presence of other linear cationic polymers such as those of the fabric treatment composition of the present disclosure. External structurants of nonionic nature may help to avoid such phase instability by having little interaction with the actives in the fabric treatment composition of the present disclosure.

The fabric treatment composition may comprise from about 0.03% to 1% by weight of the composition of a naturally derived and/or synthetic polymeric structurant. Suitable cellulose fibers may comprise fibers having an aspect ratio (length to width ratio) from about 50 to about 100,000, optionally from about 300 to about 10,000, and may be selected from the group consisting of mineral fibers, fermentation derived cellulose fibers, fibers derived from mono- or di-cotyledons such as vegetables, fruits, seeds, stem, leaf and/or wood derived cellulose fibers, and mixtures thereof.

In one aspect, the external structuring system may comprise microfibrillated cellulose derived from vegetables or wood. In one aspect, the microfibrillated cellulose may comprise a material selected from the group consisting of sugar beet, chicory root, food peels, and mixtures thereof. The microfibrillated cellulose may be a fermentation derived cellulose.

Microfibrillated cellulose (MFC) derived from vegetables or wood, has been found to be suitable for use as an external structurant, for liquid compositions comprising at least one surfactant. Suitable vegetables, from which the MFC can be derived, may include, but are not limited to: sugar beet, chicory root, potato, carrot, and other such carbohydrate-rich vegetables. Vegetables or wood can be selected from the group consisting of: sugar beet, chicory root, and mixtures thereof. Vegetable and wood fibers comprise a higher proportion of insoluble fiber than fibers derived from fruits, including citrus fruits. Preferred MFC are derived from vegetables and woods which comprise less than about 10% soluble fiber as a percentage of total fiber. Suitable processes for deriving MFC from vegetables and wood include the process described in U.S. Pat. No. 5,964,983.

MFC is a material composed of nanosized cellulose fibrils, typically having a high aspect ratio (ratio of length to cross dimension). Typical lateral dimensions are from about 1 to about 100 nanometers, or from about 5 to about 20 nanometers, and longitudinal dimension is in a wide range from nanometers to several microns. For improved structuring, the MFC preferably has an average aspect ratio (lid) of from about 50 to about 200,000, optionally from about 100 to about 10,000.

Sugar beet pulp (SBP) is a by-product from the beet sugar industry. On a dry weight basis, sugar beet pulp typically contains 65-80% polysaccharides, consisting roughly of 40% cellulose, 30% hemicelluloses, and 30% pectin.

Chicory (*Cichorium intybus* L.) belongs to the Asteraceae family and is a biennial plant with many applications in the food industry. The dried and roasted roots are used for flavoring coffee. The young leaves can be added to salads and vegetable dishes, and chicory extracts are used for foods, beverages and the like. Chicory fibers, present in chicory root, are known to comprise pectine, cellulose, hemicelluloses, and inulin. Inulin is a polysaccharide which is composed of a chain of fructose units with a terminal glucose unit. Chicory roots are particularly preferred as a source of inulin, since they can be used for the production of inulin which comprises long glucose and fructose chains. Chicory fibers, used to make the MFC, can be derived as a by-product during the extraction of inulin. After the extraction of the inulin, chicory fibers typically form much of the remaining residue.

The fibers derived from sugar beet pulp and chicory comprise hemicelluloses. Hemicelluloses typically have a structure which comprises a group of branched chain compounds with the main chain composed of alpha-1,5-linked 1-arabinose and the side chain by alpha-1,3-linked 1-arabinose. Besides arabinose and galactose, the hemicelluloses also may contain xylose and glucose. Before use for structuring purposes, the fibers can be enzymatically treated to reduce branching.

Microfibrils, derived from vegetables or wood, include a large proportion of primary wall cellulose, also called parenchymal cell cellulose (PCC). It is believed that such microfibrils formed from such primary wall cellulose provide improved structuring. In addition, microfibrils in primary wall cellulose are deposited in a disorganized fashion, and are easy to dissociate and separate from the remaining cell residues via mechanical means.

The MFC can be derived from vegetables or wood which has been pulped and undergone a mechanical treatment comprising a step of high intensity mixing in water, until the vegetable or wood has consequently absorbed at least 15 times its own dry weight of water, or even at least 20 times its own dry weight, in order to swell it. It may be derived by an environmentally friendly process from a sugar beet or chicory root waste stream. This makes it more sustainable than prior art external structurants. Furthermore, it requires no additional chemicals to aid its dispersal and it can be made as a structuring premix to allow process flexibility. The process to make MFC derived from vegetables or wood, particularly from sugar beet or chicory root, is also simpler and less expensive than that for bacterial cellulose.

MFC derived from vegetables or wood, can be derived using any suitable process, such as the process described in U.S. Pat. No. 5,964,983. For instance, the raw material, such as sugar beet or chicory root, can first be pulped, before being partially hydrolyzed, using either acid or basic hydrolysis, to extract the pectins and hemicelluloses. The solid residue can then be recovered from the suspension, and a second extraction under alkaline hydrolysis conditions can be carried out, before recovering the cellulosic material residue by separating the suspension after the second extraction. The one or more hydrolysis steps are typically done at a temperature of from 60° C. to 100° C., more typically at from 70° C. to 95° C., with at least one of the hydrolysis steps being preferably under basic conditions. Caustic soda, potash, and mixtures thereof, is typically used at a level of less than 9 wt %, more preferably from 1% to 6% by weight of the mixture, for basic hydrolysis. The residues are then typically washed and optionally bleached to reduce or remove coloration. The residue is then typically made into an aqueous suspension, usually comprising 0.5 to 15 wt % solid matter, which is then homogenized. Homogenization can be done using any suitable equipment, and can be carried out by mixing or grinding or any other high mechanical shear operation, typically followed by passing the suspension through a small diameter orifice and preferably subjecting the suspension to a pressure drop of at least 20 MPa and to a high velocity shearing action followed by a high velocity decelerating impact.

OPTIONAL COMPONENTS

In one aspect, the composition may comprise one or more adjunct components. A non-limiting list of adjuncts illustrated hereinafter that suitable for use in the instant compositions and that may be desirably incorporated in certain aspects are set forth below. In addition to the foregoing adjunct components, suitable examples of other adjuncts and levels of use are found in U.S. Pat. Nos. 5,576,282; 6,306,812 B1; and 6,326,348 B1.

METHODS OF USE

In one aspect, a method of treating a fabric is disclosed, the method comprising the steps of contacting a fabric with a fabric treatment composition wherein the fabric treatment composition comprises from about 2.5% to about 20% by weight of the composition of a cationic polymer; from about 0.1% to about 20% by weight of the composition of a perfume; and a surfactant system, wherein said surfactant system comprises alkyl polyglucoside; and wherein said composition comprises less than 5% by weight of the composition of an anionic surfactant.

The method of treating a fabric may further comprise the steps of washing, rinsing, and/or drying the fabric before the step of contacting the fabric with the fabric treatment composition. Alternatively, the method of treating a fabric may further comprise the steps of washing, rinsing, and/or drying the fabric after the step of contacting the fabric with the fabric treatment composition. In one aspect, the method may further comprise the step of contacting the fabric with an effective amount of a softener composition, wherein the softener composition comprises a fabric softening active (FSA). Examples of products containing fabric softener compositions may include but are not limited to fabric softener compositions such as those sold under the tradenames DOWNY FABRIC SOFTENER manufactured by The Procter & Gamble Company, Cincinnati, Ohio, USA and SNUGGLE FABRIC SOFTENER manufactured by The Sun Products Corporation, Wilton, Conn., USA. The step of contacting the fabric with an effective amount of the softener composition may occur before the steps of washing, rinsing, and/or drying the fabric. The step of contacting the fabric with an effective amount of the softener composition may occur after the steps of washing, rinsing, and/or drying the fabric. In one aspect, the method of treating a fabric may comprise the step of contacting the fabric with an external source of anionic surfactant before the step of contacting the fabric with the fabric treatment composition. The method of treating a fabric may further comprise the step of contacting the fabric with an external source of anionic surfactant before the steps of washing, rinsing, and/or drying the fabric. Contacting the fabric with an external source of anionic surfactant before the steps of washing, rinsing, and/or drying the fabric before or after the step of contacting the fabric with the fabric treatment composition may allow a greater color rejuvenation benefit in that the step provides for anionic surfactant to be present on the fabric which may allow for the anionic surfactant from the external source to form a coacervate with the fabric treatment composition. Without wishing to be bound by theory, it is believed that when there is anionic surfactant already on the fabric, the cationic polymer within the fabric treatment composition may then interact with the anionic surfactant in such a way as to form a coacervate that more readily deposits on the fabric as compared to the cationic polymer in the fabric treatment composition interacting with free floating anionic surfactant not found on the fabric, interacting to form a coacervate, and then inefficiently depositing the coacervate on the fabric.

The fabric may be actively dried, such as in an automatic drying machine. The fabric may be passively dried, such as line-dried or dried when placed over a radiator. The method may comprise the steps of washing, rinsing, and/or drying the fabric before the step of contacting the fabric with the fabric treatment composition wherein the fabric is actively dried or passively dried.

In one aspect, the fabric treatment composition and the source of anionic surfactant may be combined in a treatment vessel. The treatment vessel may be any suitable reservoir sufficient to allow the fabric treatment composition and the source of anionic surfactant to interact, and may include top loading, front loading and/or commercial washing machines. In one aspect, the treatment vessel may be filled with water or other solvent before the addition of the fabric treatment composition. In one aspect, the fabric treatment composition and source of anionic surfactant may be combined in the presence of water.

The contacting step of the method may be carried out at a temperature of from about 15° C. to about 40° C. when combined within a treatment vessel. The contacting step of the method may be carried out at ambient temperature when combined outside of a treatment vessel.

In one aspect, the method may be carried out as a service to a consumer. In this aspect, the method may be carried out in a commercial establishment at the request of a consumer. The method may be carried out at home by the consumer.

The benefit may comprise a benefit selected from the group consisting of color maintenance and/or rejuvenation, abrasion resistance, wrinkle removal, pill prevention, anti-shrinkage, anti-static, anti-crease, fabric softness, fabric shape retention, suds suppression, decreased residue in the wash or rinse, improved hand feel or texture, and combinations thereof.

The benefit may comprise color maintenance and/or rejuvenation appearance benefits to the fabric. In this aspect, the appearance benefit on the treated fabrics, as measured on dry according to the Test Methods herein, may have a ΔL value of from about −0.3 to about −2, or from about −0.5 to about −1.5 on damaged fabrics where a negative ΔL value may indicate a darkening of the black color. The compositions of the present invention may also maintain the color of black garments on new garments may have a $\Delta L_{treated\text{-}new}$ from about 0, which may mean no change, to about +0.75, or from about 0, which may mean no change, to about +0.5. In some aspects, damaged fabrics may be treated until a AL value of from about −0.3 to about −2, or from about −0.5 to about −2.0 is achieved.

In one aspect, a method of forming a fabric treatment composition is disclosed, the method comprising the steps of forming an emulsion composition comprising a cationic polymer, a perfume, and an alkyl polyglucoside, and then adding a suds suppressor to the composition, and then adding an external structurant system to the composition.

Combinations:

Specifically contemplated combinations of the disclosure are herein described in the following lettered paragraphs. These combinations are intended to be illustrative in nature and are not intended to be limiting.

A. A fabric treatment composition comprising from about 2.5% to about 20% by weight of the composition of a cationic polymer; from about 0.1% to about 20% by weight of the composition of a perfume; and a surfactant system, wherein said surfactant system comprises alkyl polyglucoside; and wherein said composition comprises less than 5% by weight of the composition of an anionic surfactant.

B. The fabric treatment composition according to paragraph A, wherein said cationic polymer comprises a polymer selected from the group consisting of cationic celluloses, cationic guars, poly(acrylamide-co-diallyldimethylammonium chloride), poly(acrylamide-co-diallyldimethylammonium chloride-co-acrylic acid), poly(acrylamide-co-methacryloamidopropyl-pentamethyl-1,3-propylene-2-ol-ammonium dichloride), poly(acrylamide-co-N,N-dimethylaminoethyl acrylate) and its quaternized derivatives, poly(acrylamide-co-N,N-dimethylaminoethyl methacrylate) and its quaternized derivatives, poly(acrylamide-co-methacrylamidopropyltrimethyl ammonium chloride), poly(acrylamide-co-methacrylamidopropyltrimethyl ammonium chloride-co-acrylic acid), poly(diallyldimethyl ammonium chloride), poly(diallyldimethylammonium chloride-co-acrylic acid), poly(ethyl methacrylate-co-oleyl methacrylate-co-diethylaminoethyl methacrylate) and its quaternized derivatives, poly(ethyl methacrylate-co-dimethylaminoethyl methacrylate) and its quaternized derivatives, poly(hydroxpropylacrylate-co-methacrylamidopropyltrimethylammonium chloride), poly(hydroxyethylacrylate-co-dimethyl aminoethyl methacrylate) and its quaternized derivatives, poly(methylacrylamide-co-dimethylaminoethyl acrylate) and its quaternized derivatives, poly(methacrylate-co-methacrylamidopropyltrimethyl ammonium chloride), poly(vinylformamide-co-diallyldimethylammonium chloride-co-acrylic acid), poly(vinylformamide-co-diallyldimethylammonium chloride), poly(vinylpyrrolidone-co-acrylamide-co-vinyl imidazole) and its quaternized derivatives, poly(vinylpyrrolidone-co-dimethylaminoethyl methacrylate) and its quaternized derivatives, poly(vinylpyrrolidone-co-methacrylamide-co-vinyl imidazole) and its quaternized derivatives, poly(vinylpyrrolidone-co-vinyl imidazole) and its quaternized derivatives, polyethyleneimine and including its quaternized derivatives, and mixtures thereof.

C. The fabric treatment composition according to paragraph A, wherein said cationic polymer is poly(diallyldimethylammonium chloride-co-acrylic acid).

D. The fabric treatment composition according to any one of paragraphs A to C, wherein said cationic polymer has a cationic charge density of from greater than 0 to about 6 meq/g at a pH of from about 2 to about 8.

E. The fabric treatment composition according to any one of paragraphs A to D, wherein said cationic polymer has a weight-average molecular weight of from about 15,000 to about 600,000, preferably from about 20,000 to about 550,000 Daltons, more preferably from about 50,000 to about 500,000 Daltons, more preferably from about 100,000 to about 500,000 Daltons.

F. The fabric treatment composition according to any one of paragraphs A to E, wherein said perfume comprises raw materials selected from the group consisting of melonal, dihydro myrcenol, freskomenthe, tetra hydro linalool, linalool, anisic aldehyde, citronellol, ionone beta, ionone alpha, geraniol, delta damascone, thio-damascone, bourgeonal, cymal, alpha damascone, ethyl linalool, lilial, ionone gamma methyl, helional, cashmeran, vanillin, amyl salicylate, ethyl vanillin, calone, iso e super, hexyl salicylate, galaxolide, nectaryl, benzyl salicylate, trichloromethyl phenyl carbinyl acetate, β-Damascenone, dihydro beta ionone, ligustral, triplal, beta naphthol methyl ether, and mixtures thereof.

G. The fabric treatment composition according to any one of paragraphs A to F, wherein said composition comprises from about 1% to about 20% by weight of the composition of said surfactant system, wherein said surfactant system is substantially free of an anionic surfactant.

H. The fabric treatment composition according any one of paragraphs A to G, wherein the alkyl group of said alkyl polyglucoside contains on the average from about 8 to about 18 carbon atoms.

I. The fabric treatment composition according to any one of paragraphs A to H, wherein said composition further comprises from about 0.01% to about 1% by weight of the composition of a suds suppressor.

J. The fabric treatment composition according to paragraph I, wherein said suds suppressor is silicone-based.

K. The fabric treatment composition according to any one of paragraphs A to J, wherein said composition further comprises from about 0.03% to about 1%, preferably from about 0.06% to about 1%, by weight of the composition of an external structuring system.

L. The fabric treatment composition according to any paragraph K, wherein said external structuring system comprises microfibrillated cellulose derived from vegetables or wood, and wherein said microfibrillated cellulose derived from vegetables comprises a material selected from the group consisting of sugar beet, chicory root, food peels, and mixtures thereof.

M. A method of treating a fabric comprising the steps of contacting a fabric with said fabric treatment composition according to any one of paragraphs A to L.

N. The method of treating a fabric according to paragraph M, further comprising the steps of washing, rinsing, and/or drying said fabric before the step of contacting said fabric with said fabric treatment composition according to any one of paragraphs A to L.

O. The method of treating a fabric according to M, further comprising the step of contacting the fabric with an effective amount of a softener composition, wherein the softener composition comprises a fabric softening active (FSA).

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitation were expressly written herein. Every numerical range given throughout this specification will include every narrower numerical range that falls within such broader numerical range, as if such narrower numerical ranges were all expressly written herein.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document not an admission that it prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A fabric treatment composition comprising:

from about 7% to about 10% by weight of the composition of a cationic polymer;

from about 0.1% to about 20% by weight of the composition of a perfume; and from about 4% to about 8% by weight of the composition of a surfactant system, wherein said surfactant system comprises at least 70%, by weight of the surfactant system, of alkyl polyglucoside, wherein the alkyl group of said alkyl polyglucoside contains on the average from about 8 to about 18 carbon atoms, and wherein said surfactant system is substantially free of an anionic surfactant and substantially free of a cationic surfactant.

2. The fabric treatment composition according to claim 1, wherein said cationic polymer comprises a polymer selected from the group consisting of cationic celluloses, cationic guars, poly(acrylamide-co-diallyldimethylammonium chloride), poly(acrylamide-co-diallyldimethylammonium chloride-co-acrylic acid), poly(acrylamide-co-methacryloamidopropyl-pentamethyl-1,3-propylene-2-ol-ammonium dichloride), poly(acrylamide-co-N,N-dimethylaminoethyl acrylate) and its quaternized derivatives, poly(acrylamide-co-N,N-dimethylaminoethyl methacrylate) and its quaternized derivatives, poly(acrylamide-co-methacrylamidopropyltrimethyl ammonium chloride), poly(acrylamide-co-methacrylamidopropyltrimethyl ammonium chloride-co-acrylic acid), poly(diallyldimethyl ammonium chloride), poly(diallyldimethylammonium chloride-co-acrylic acid), poly(ethyl methacrylate-co-oleyl methacrylate-co-diethylaminoethyl methacrylate) and its quaternized derivatives, poly(ethyl methacrylate-co-dimethylaminoethyl methacrylate) and its quaternized derivatives, poly(hydroxpropylacrylate-co-methacrylamidopropyltrimethylammonium chloride), poly(hydroxyethylacrylate-co-dimethyl aminoethyl methacrylate) and its quaternized derivatives, poly (methylacrylamide-co-dimethylaminoethyl acrylate) and its quaternized derivatives, poly(methacrylate-co-methacrylamidopropyltrimethyl ammonium chloride), poly(vinylformamide-co-diallyldimethylammonium chloride-co-acrylic acid), poly(vinylformamide-co-diallyldimethylammonium chloride), poly(vinylpyrrolidone-co-acrylamide-co-vinyl imidazole) and its quaternized derivatives, poly(vinylpyrrolidone-co-dimethylaminoethyl methacrylate) and its quaternized derivatives, poly(vinylpyrrolidone-co-methacrylamide-co-vinyl imidazole) and its quaternized derivatives, poly (vinylpyrrolidone-co-vinyl imidazole) and its quaternized derivatives, polyethyleneimine and including its quaternized derivatives, and mixtures thereof.

3. The fabric treatment composition according to claim 1, wherein said cationic polymer comprises a polymer selected from the group consisting of poly(acrylamide-co-diallyldimethylammonium chloride), poly(diallyldimethylammonium chloride-co-acrylic acid), poly(methylacrylamide-co-dimethylaminoethyl acrylate) and its quaternized derivatives, poly(vinylformamide-co-diallyldimethylammonium chloride-co-acrylic acid), poly(vinylformamide-co-diallyldimethylammonium chloride), poly(vinylpyrrolidone-co-acrylamide-co-vinyl imidazole) and its quaternized derivatives, poly(vinylpyrrolidone-co-methacrylamide-co-vinyl imidazole) and its quaternized derivatives, and mixtures thereof.

4. The fabric treatment composition according to claim 1, wherein said cationic polymer is poly(diallyldimethylammonium chloride-co-acrylic acid).

5. The fabric treatment composition according to claim 1, wherein said cationic polymer has a cationic charge density of from greater than 0 to about 6 meq/g at a pH of from about 2 to about 8.

6. The fabric treatment composition according to claim 1, wherein said cationic polymer has a weight-average molecular weight of from about 15,000 to about 600,000 Daltons.

7. The fabric treatment composition according to claim 1, wherein said perfume comprises raw materials selected from the group consisting of melonal, dihydro myrcenol, freskomenthe, tetra hydro linalool, linalool, anisic aldehyde, citronellol, ionone beta, ionone alpha, geraniol, delta damascone, thio-damascone, bourgeonal, cymal, alpha damascone, ethyl linalool, lilial, ionone gamma methyl, helional, cashmeran, vanillin, amyl salicylate, ethyl vanillin, calone, iso e super, hexyl salicylate, galaxolide, nectaryl, benzyl salicylate, trichloromethyl phenyl carbinyl acetate, β-Damascenone, dihydro beta ionone, ligustral, triplal, beta naphthol methyl ether, and mixtures thereof.

8. The fabric treatment composition according to claim 1, wherein said composition further comprises from about 0.01% to about 1% by weight of the composition of a suds suppressor.

9. The fabric treatment composition according to claim 8, wherein said suds suppressor is silicone-based.

10. The fabric treatment composition according to claim 1, wherein said composition further comprises from about 0.03% to about 1% by weight of the composition of an external structuring system.

11. The fabric treatment composition according to claim 10, wherein said external structuring system comprises microfibrillated cellulose derived from vegetables or wood.

12. The fabric treatment composition according to claim 11, wherein said microfibrillated cellulose comprises a material selected from the group consisting of sugar beet, chicory root, food peels, and mixtures thereof.

13. The fabric treatment composition according to claim 1, wherein said surfactant system comprises at least 80%, by weight of the surfactant system, of alkyl polyglucoside.

14. A method of treating a fabric comprising the steps of contacting a fabric with a fabric treatment composition according to claim 1.

15. The method of treating a fabric according to claim 14, further comprising the steps of contacting said fabric with an external source of anionic surfactant before the step of contacting said fabric with said fabric treatment composition.

16. The method of treating a fabric according to claim 14, further comprising the steps of washing, rinsing, and/or drying said fabric after the step of contacting said fabric with said fabric treatment composition.

17. The method of treating a fabric according to claim 16, wherein said fabric is actively dried or wherein said fabric is passively dried.

18. The method of treating a fabric according to claim 17, further comprising the steps of washing, rinsing, and/or drying said fabric before the step of contacting said fabric with said fabric treatment composition.

19. The method of treating a fabric according to claim 18, further comprising the step of contacting the fabric with an effective amount of a softener composition, wherein said softener composition comprises a fabric softening active (FSA).

* * * * *